US005139366A

United States Patent [19]

Choate et al.

[11] Patent Number: 5,139,366

[45] Date of Patent: Aug. 18, 1992

[54] OFFSHORE JACKUP RIG LOCKING APPARATUS AND METHOD

[75] Inventors: Kenneth P. Choate, Houston; John S. Laird, II, Cypress, both of Tex.

[73] Assignee: Amfels, Inc., Houston, Tex.

[21] Appl. No.: 694,584

[22] Filed: May 2, 1991

[51] Int. Cl.[5] ..... E02B 17/06

[52] U.S. Cl. ..... 405/198

[58] Field of Search ..... 405/196, 197, 198, 199, 405/200; 254/95, 105, 108-111

[56] References Cited

U.S. PATENT DOCUMENTS

| | | | |
|---|---|---|---|
| Re. 32,589 | 2/1988 | Goldman et al. | 405/198 |
| 4,255,069 | 5/1981 | Yielding | 405/196 |
| 4,389,140 | 6/1983 | Bordes | 405/195 |
| 4,431,343 | 2/1984 | Uchiyama et al. | 405/198 |
| 4,479,401 | 10/1984 | Korkut | 74/527 |
| 4,505,616 | 3/1985 | Grzelka et al. | 405/198 |
| 4,538,938 | 9/1986 | Grzelka et al. | 405/198 |
| 4,589,799 | 5/1986 | Hotta et al. | 405/196 |
| 4,662,787 | 5/1987 | Tatsuguchi | 405/198 |
| 4,813,814 | 3/1989 | Shibuta et al. | 405/198 |

*Primary Examiner*—David H. Corbin
*Attorney, Agent, or Firm*—Guy McClung

[57] ABSTRACT

A locking apparatus and method for an offshore jackup rig having at least one leg extending through the hull and at least one set of rack teeth attached to each of the legs. One or more locking bars are supported from the hull and are movable in a direction substantially normal to the face of the rack teeth. A piston and cylinder power assembly moves the bars towards the teeth and a retention system engages the bars holding them in engagement with the teeth. The elevating system of the rig coacts with the set bars to lock the hull and legs together.

18 Claims, 6 Drawing Sheets

OFFSHORE JACKUP RIG LOCKING APPARATUS AND METHOD

BACKGROUND OF THE INVENTION

This invention relates to a locking support system for a self-elevating platform or jackup rig, which works in conjunction with the platform elevating system and is intended to support the weight of the platform and the storm reactions from the jackup rig legs. More specifically, this invention relates to a locking apparatus including one or more locking bars at each leg or leg chord, housed in a support foundation and secured by a retaining device, which engages the rack teeth on the leg or leg chords.

Offshore platforms have been used extensively by the oil and gas industry in continental shelf regions for oil and gas drilling, production operations, pipeline pumping stations, accommodation and service operations. Fixed offshore platforms, intended to remain in one location, are traditionally built onshore, transported by barge to the offshore location, launched and rotated into an upright position, and permanently affixed to the seafloor.

Mobile offshore vessels have been developed to meet the offshore industries needs for a facility from which to conduct drilling, production, or workover operations which will predominantly remain at any one location for a relatively short period of time, but which could also be used for extended periods of time as a production unit, accommodations unit, etc. Several different design types have been developed to meet the needs of the offshore industry including semi-submersible or floating drillships for deep water, posted barges for inland waters or bayous, and jackup platforms for shallow to moderate water depths. The jackup rig incorporates a barge shaped hull which may be towed as a floating vessel from one location to another with the majority of or all of its legs raised up through the hull above the water. Upon reaching the intended location, the elevating system will lower the legs through wells in the barge hull until firmly engaged with the ocean floor. Continued jacking down on the legs will result in penetration of the legs into the seafloor until a firm foundation for the footings is achieved such that the barge hull can then be lifted up and out of the water. Further jacking will serve to lift the hull up until the bottom of the barge reaches an elevation above the sea greater than the highest anticipated wave height during a severe ocean storm.

Henceforth, "jackup" shall pertain to any self-elevating offshore platform with one or more legs, each leg consisting of one or more chords, used for drilling, production, workover, or other offshore operations or work, which has the ability of being supported on jackable legs to the seafloor, with the capability of relocating from one offshore location to another by lowering to an afloat position, being moved to a new offshore position, and raising itself again to an elevated position. The subject invention pertains to a locking system to support the hull or legs of a jackup rig such as previously described or to support or lock in position any slidable or skidable equipment which commonly used rack and pinion systems for translation or elevation and/or any equipment which may benefit from the use of the subject invention as a locking or position holding system.

Various designs have been utilized to jack the supporting legs with respect to the platform hull. The most popular design has been the use of a rack and pinion system with one or more racks extending longitudinally along the length of each jackup unit leg or leg chords. Racks mounted to the legs mesh with pinion gears which are driven by hydraulic or electric gear drive assemblies, all mounted to frames, the combination of which is referred to as jacking units or jacking frames which are in turn mounted to the deck or internal structure of the platform hull. The pinion gears may be arranged such that the face of the pinion teeth face the center of a trussed leg with multiple chords or they may be oriented as opposed pinions with a rack mounted on each side of a leg or leg chord to engage the opposing pinions. The pinions may be, and are normally stacked vertically for all configurations to provide enough pinions to lift the desired loads. The present invention may be used with any type of jackup leg, jacking system or leg chord configuration.

The jackup rig is subjected to large environmental loadings from storms consisting of wind forces on the platform and the legs above the water in addition to ocean current and wave forces on the submerged portion of the legs. These forces result in a large overturning moment imposed on the jackup rig. The combination of these forces together with the weight of the platform can result in large interaction forces between the platform and the legs which must then be resolved at the leg to hull interface or connection.

As the design of the jackup unit evolved, three distinct design methodologies have emerged as solutions to resolution of the high interaction forces at the leg to hull interface. The three different methodologies are outlined below.

1. A "floatingjack" elevating system consisting of jacking units for each leg chord mounted on resilient pads. With this type of jack support, the moment transfer between the platform and the legs is taken primarily through horizontal forces at the upper end lower leg guides rather than vertical forces at the jack units. This method also requires substantial upper and lower guides structures to carry the large horizontal reactions back into the hull.
2. A "fixed jack" elevating system consisting of jacking units rigidly affixed to the hull. In this case, the pinions will tend to absorb the majority of the overturning moment as vertical couple reactions at the pinions. The capability of the rig to resist the severe environmental conditions will be limited by the storm holding capability of the jacks, or additional pinions will have to be provided in excess of the number required for elevating the platform out of the water. This is an undesirable option given the cost of the additional pinions.
3. A "locking system" consisting of a section of rack with a profile matching the leg rack, normally referred to as a "rack chock", and a multitude of mechanisms for aligning vertically and engaging horizontally the chock elements. This rack chock is commonly designed to resolve the overturning moment imposed on the jackup unit into vertical couple reactions from the leg chords and transfer it directly into the hull. The rack chocks are capable of being adjusted vertically with various mechanisms until aligned with the rack at which point the chock is engaged horizontally by same or additional mechanisms to make rigid contact with the leg. This system is normally independent of the jacking system, although they may share a common foundation, such that the load supported by the jacking pinions may be released or even be removed if required. As the locking systems and the supporting structure are commonly designed to be very stiff, the overturning moment imposed on the jackup unit by the environmental conditions is resolved as vertical load components carried by the rack chocks. The advantages of this design are a reduction in the weight of the leg, elevating pinions are sized only for the required lifting capacity and a reduction in size of the structure required to support the upper and lower guides.

Each of the three design solutions has merit and have proven to be appropriate for different operator requirements and offshore environments. However, the use of a locking or locking system of some description, for locking the jackup leg to the barge hull, has proven to be the most efficient design for the large jackup units intended for harsh environmental conditions and deep water. This has prompted significant design activity, resulting in the following United States patents: U.S. Pat. Nos. 4,255,069; 4,389,140; 4,431,343; 4,538,938; 4,589,799; 4,662,787; and Re. 32,589.

Existing locking systems to date have some structural disadvantages and difficulties in operation and maintenance. As the rack sections for the leg chords are normally manufactured using flame cutting, rack profiles are cut with some degree of imprecision or out of tolerance, resulting in dimensional variations in tooth profiles and tooth spacing. Because of these dimensional variations and the fact that the rack chock cannot be custom fitted to the leg rack due to the relative position of the barge hull being a variable over the length of the leg rack, it cannot be assured that more than one rack tooth on the leg or leg chord has made load bearing contact with the teeth of the rack chock element.

When a jackup unit is outfitted with a conventional locking system and is subjected to storm conditions, the vertical couple reactions from resolution of the overturning moment can tend to concentrate on the lower support face of the rack chock even if all teeth are in perfect contact. This imbalance may overload and damage the lower rack teeth on the chock element and the corresponding rack teeth on the leg chord. It is also difficult to vertically position the rack chock element accurately to the leg rack when using a screw jack system attached to the top, bottom and back of the chock elements or using screw jacks on wedge shaped chock elements. This can result in unbalanced load sharing on the teeth of both the rack and the chock. Some arrangements of the locking systems use screw jack elements to directly or vectorial support the reactions absorbed by the chock element from the leg or leg chord. This design can lead to damage of the screw spindles or make their operation difficult.

The design and operation of the actuating mechanisms for alignment and engagement of the rack chock element can lead to jamming and chock element removal problems. As all the existing designs depend on the locking system, independent of the jacking system, to restrain the leg chord against vertical movement in both directions, the possibility exists to jam up the actuating mechanisms by overdriving the screw jacks during final engagement.

To install the rack chocks, the normal procedure is to first vertically position the chock element, then drive the screw elements mounted on the top and bottom of the chock element against each other, thereby removing any slack in the connection of the screws spindles to the chock element. After this, the load may be transferred from the elevating pinions to the rack chocks by backdriving the pinions. For removal of the chock element, the practice is to "unload" the rack chocks by engaging the elevating pinions to slightly lift the barge hull, then use the screw mechanisms to retract the chock.

Due to tight tolerances on the screw jacks, it may prove difficult to identify when the load has been transferred from the locking system to the elevating pinions, or if the pinions have driven the chock element against the lower screw jack. As the screw jacks cannot be released until the load has been removed by the elevating pinions, removal of all the rack chock element can become a tedious and time consuming process and may have to be performed one leg chord at a time. One purpose of this invention is to simplify this process.

SUMMARY

It is, therefore, the object of this invention to provide a unique locking apparatus for locking the hull of a jackup rig to the legs which is simple, inherently quick and easy to operate and eliminates the disadvantages of the existing locking devices.

It is an object of the invention to provide as the primary element of the system, one or more locking elements, herein referred to as "locking bars", for locking the barge hull relative to the legs and resolution of the leg to hull interaction forces into primarily vertical components for efficient distribution of forces into the barge hull at secure design locations.

It is a further object of the invention to provide a system which incorporates the use of the jacking system as a locking component to provide the load reversal locking for the jackup unit legs when subjected to extreme environmental conditions in an afloat or elevated condition.

It is another object of the invention to provide locking bars that are self-aligning for ease of installation and once installed, are locked by simply backdriving the elevating pinions.

It is still another object of the invention to provide locking bars which can easily adapt to the dimensional variances of the rack tooth profiles on the legs or leg chords caused by the manufacturing process.

It is a further object of the invention to provide locking bars which may be sized and/or lengthened such that each of the multiple locking bars at a leg or leg chord, and therefore the rack teeth on the jackup unit legs, will receive the most appropriate and nearly equal loading.

It is yet another object of the invention to provide a locking system which is easily withdrawn, allowing simultaneous removal of all locking bars if required. This can be accomplished by energizing the locking system to remove the locking bars and the bar retention devices, then activating the elevating system to lift the barge hull, thereby unloading the locking system allowing the retention devices and the locking bars to retract. This invention also benefits from a fail-safe feature, in that if the locking bars become jammed for some reason, lowering of the hull will safely remove the locking bars, once the locking bar retention devices are removed.

Still a further object of the present invention is the provision of a locking system including a plurality of locking bars which easily adapt to the dimensional variances of the rack tooth profiles on the legs or leg chords.

Yet a still further object of the present invention is the provision of an offshore jackup rig locking apparatus for use in an offshore rig having at least one leg extending through a hull and at least one set of rack teeth attached to each of the legs including a plurality of locking bars supported from the hull. Each of the bars are movable in a direction substantially normal to the face of one of the teeth and each of the bars is movable relative to the other bars to accommodate inaccuracies in the configuration of the teeth. Power means are provided for moving the bars towards the teeth and retention means are provided to engage each of the locking bars thereby holding each of the locking bars in engagement with one of the teeth.

Still a further object of the present invention is wherein each of the bars includes a recess thus allowing vertical movement of a rack tooth during a disengagement operation therefore assuring contact will not be made between the locking bar and the bottom of the rack teeth.

Yet a still further object of the present invention is wherein the retention means includes a wedge member transversely movable relative to the longitudinal axis of each of the locking bars. Preferably, hydraulic or pneumatic power means are provided for longitudinally moving the bars, and the wedge means individually retain each of the locking bars for providing even engagement on all of the locking bars. Yet a still further object of the present invention is wherein the locking bars are interlocked with each other with a lost motion connection to assist in engagement and disengagement.

It is a further object of the invention to provide an additional locking system which would, if installed on the jackup rig in addition to the first locking system designed to support and lock the position of the platform hull, support and lock into position the legs of the jackup rig when the legs are in the fully or partially elevated position. This additional system is installed in an inverted configuration, with the locking bars being slid upwards for engagement with the bottom face of the rack teeth. The elevating pinions would provide a locking component for this configuration, by backdriving the pinions to lower the legs onto the inverted locking bars, thereby establishing load reversal locking.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

While the present invention will be described in connection with its use on an offshore jackup drilling rig, for purposes of illustration only, it is to be understood that the present locking apparatus may be used on any type of offshore jackup rig having at least one leg extending through a hull and at least one set of rack teeth attached to each of the legs.

Figure 1:
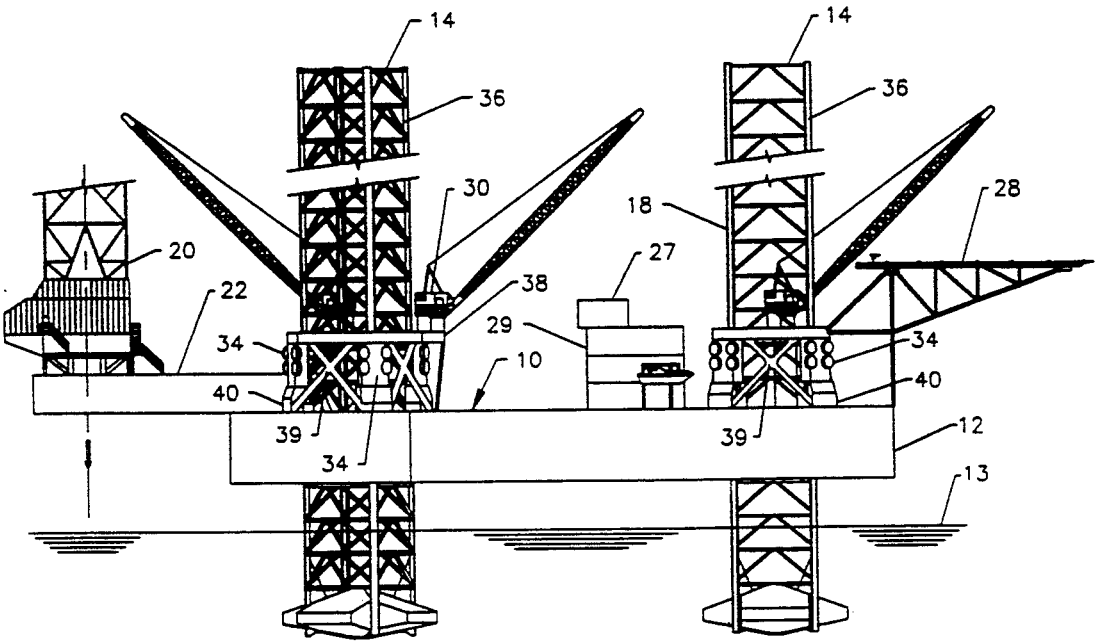
FIG. 1 is an elevational view of a jackup rig embodying the present invention.
Figure 2:
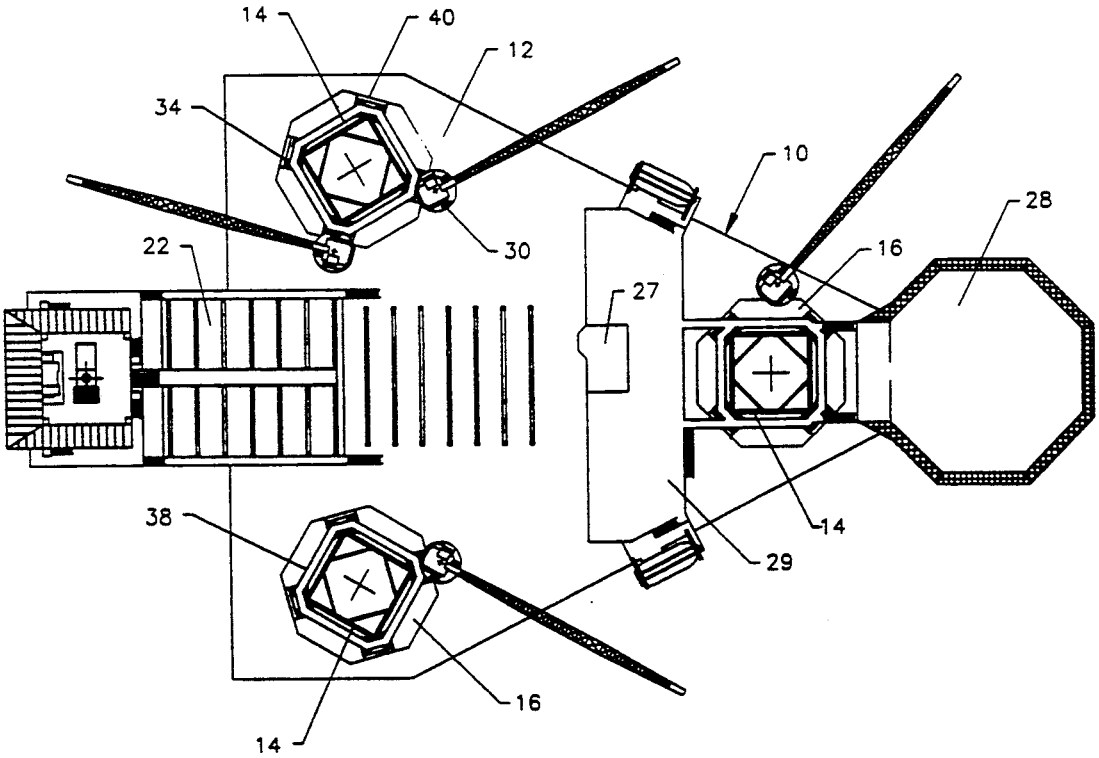
FIG. 2 is a plan view of the jackup rig of FIG. 1.

Referring now to the drawings, particularly to FIGS. 1 and 2, the reference numeral 10 generally indicates a jackup rig 10 which includes a barge type hull or deck 12 having at least one leg 14, here shown as three, which movably extend through the hull 12 within spud wells 16 and at least one set of rack teeth 18 attached to each of the legs 14. The hull 10 supports the legs 14 in an upright position when in the afloat position. When the rig 10 arrives at its intended location, the legs 14 are lowered down until firmly engaged with the ocean floor. Continued jacking on the legs 14 will serve to lift the hull 12 to a nominal height above the body of water 13 for preload operations. Upon the completion of preloading, jacking resumes until the bottom of the hull 12 reaches an elevation above the sea greater than the highest wave height anticipated during a severe ocean storm.

The main deck of the hull 12 may be outfitted with the necessary equipment to conduct drilling, production or workover operations, such as a derrick 20, a cantilever beam and elevated pipe rack 22, pilot house 27, heliport 28, crew quarters 29, as well as general purpose cranes 30.

Figure 3:
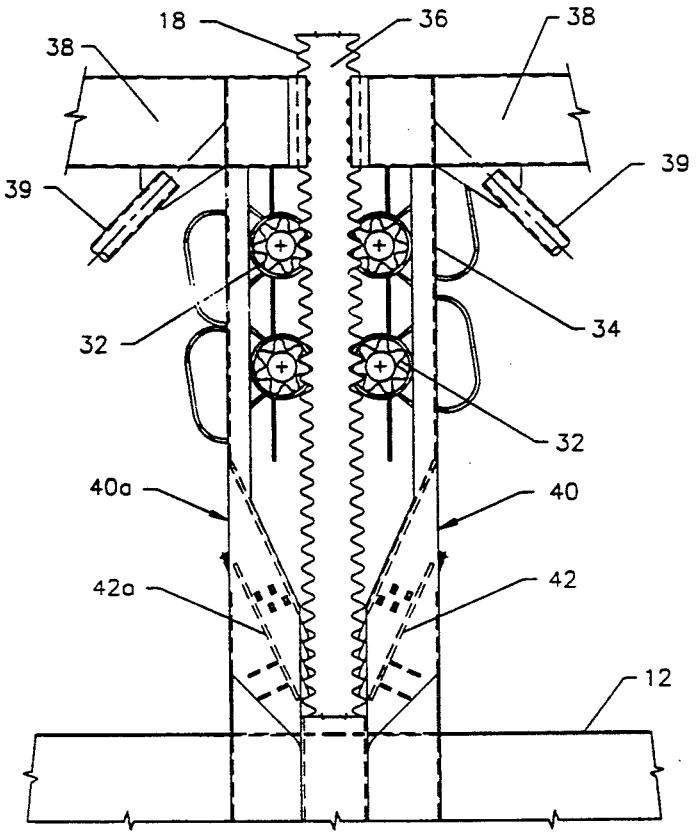
FIG. 3 is an enlarged fragmentary elevational view illustrating one embodiment of the locking apparatus of the present invention.

Referring now to FIGS. 1 and 3, self-elevation of the hull 12 of the jackup rig 10 may be achieved by a number of different techniques which are well known to the industry. One form of elevation system for which the present invention is particularly useful is commonly known as a rack and pinion elevating system. With this system, elevating pinions 32 are housed in a jacking frame 34, on and within which is mounted suitable electric or hydraulic drive mechanism and gear train (not shown) to drive the elevating pinions 32. The elevating pinions 32 engage the rack teeth 18 on a leg chord 36. Rotation of the pinions 32 in one direction will serve to carry the legs 14 upwardly relative to the hull 12, while rotation of the pinions 32 in the opposite direction will serve to lower the legs 14 relative to the hull 12.

An upper guide structure 38 is mounted above the jacking frame 34 and is used as an upper guide/support structure to control the position of the legs 14. The upper guides structure 38 is laterally supported back to the hull or deck 12 with brace beams 39. Each of the legs 14 normally consist of one or more generally vertically extending leg chords 36 which are structurally tied together by suitable bracing such as a conventional "K" configuration or "X" configuration. For the embodiment shown in FIGS. 1 and 3, rack teeth 18 are provided on both sides of four chords of each leg 14. For smaller platforms, the leg members may consist of a single leg or leg chord with one or more tooth rack 18 thereon.

Referring now to FIGS. 1 and 3, the preferred embodiment of the locking apparatus 40 and its preferred relationship to the other components is best seen. That is, the locking apparatus 40 is positioned below the jacking frame 34 and the jacking frame 34 is positioned below the upper guide frame 38. The support foundation 42 for the locking apparatus 40 is mounted below the jacking frame 34 and is rigidly welded to the hull 12. As shown, the jacking frame 34 and support foundation 42 share a common foundation for efficiency. It should be pointed out that other configurations of the locking system 40, jacking frame 34 and upper frame 38 may be advantageous depending upon the design of the hull, leg and/or selection of the type of elevating system.

The preferred embodiment of the locking apparatus 40 of the present invention is best seen in FIGS. 3, 4, 5, 6, and 7. While the preferred embodiment includes a second locking means 40*a*, the second locking means 40*a* is a mirror image of the locking means 40, and only locking means 40 will be fully described. It is also understood that if desired only a single one of the locking means 40 or 40*a* may be provided. The locking apparatus 40 consists of at least one locking bar 44, but preferably a plurality of locking bars 44*a*, 44*b*, 44*c*, and 44*d*. Of course, any desired number can be utilized as desired. Each of the locking bars is movable in a direction substantially normal to the face of one of the teeth on the set of rack teeth 18. Thus, locking bar 44*a* is adapted to be longitudinally movable in a direction substantially normal to the face of tooth 19*a*. Similarly, locking bars 44*b*, 44*c* and 44*d* are adapted to normally engage the upper faces of teeth 19*b*, 19*c*, and 19*d*, respectively. By engaging the pitch line 17 of tooth 19*a*, a greater resultant force may be carried by the rack teeth 18. Power means are provided for moving the locking bars 44*a*, 44*b*, 44*c* and 44*d* towards and away from the teeth on the rack teeth 18. For example, a hydraulic piston and cylinder assembly 46 as a unit may be provided. All of the locking bars 44*a*, 44*b*, 44*c*, and 44*d* can be actuated by the piston and cylinder assembly 46 by providing coacting shoulders between the bars to generally move them in unison as a unit. However, it is important to note that a lost motion connection is provided between each of the locking bars and their adjacent connected locking bar in order to insure that each of the bars is longitudinally movable relative to the other bars in order to accommodate inaccuracies in the configuration of the teeth on the rack teeth 18. That is, as previously discussed, the rack teeth 18 are normally manufactured using flame cutting, and the rack profiles are cut with some degree of imprecision or out of tolerance resulting in dimensional variations in the tooth profiles and even tooth spacing. Therefore, in order to insure that each of the separate locking bars 44*a*, 44*b*, 44*c*, and 44*d* engage and carry a substantial equal amount of load, it is important that the bars be able to longitudinally move independent of each other a sufficient amount to engage their respective tooth face and carry their proportional amount of load.

In order to insure that the locking bars remain engaged against the face of a tooth, suitable retention means are provided for engaging each of the locking bars. Thus, wedges 50*a*, 50*b*, 50*c*, and 50*d*, are provided for extending through openings 52*a*, 52*b*, 52*c*, and 52*d*, in each of the bars 44*a*, 44*b*, 44*c*, 44*d*. Each of the wedges is actuated by a piston and cylinder assembly, such as air or hydraulic piston and cylinder assemblies 54*a*, 54*b*, 54*c*, and 54*d*, respectively. It is to be noted that the support foundation 42 also includes openings for coacting and receiving the wedges 50*a*, 50*b*, 50*c*, and 50*d*. In particular, it is to be noted that because of the movable relationship of the locking bars relative to each other, they are individually locked by their locking wedges and with uniform locking pressure on the piston and cylinder assemblies 54*a*, 54*b*, 54*c*, and 54*d*, the locking bars 44*a*, 44*b*, 44*c*, and 44*d* will individually engage the tooth faces 19*a*, 19*b*, 19*c*, and 19*d*, respectively, with a substantial equal force.

Figure 8:
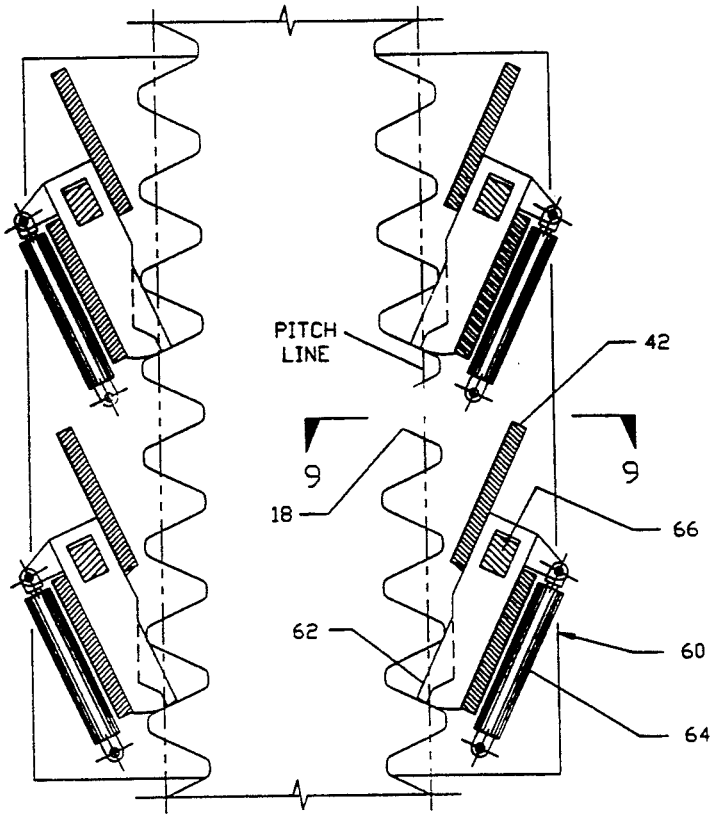
FIG. 8 is a fragmentary elevational view, partly in cross section, illustrating another embodiment of the present invention and taken along the line 8—8 of FIG. 9.
Figure 9:
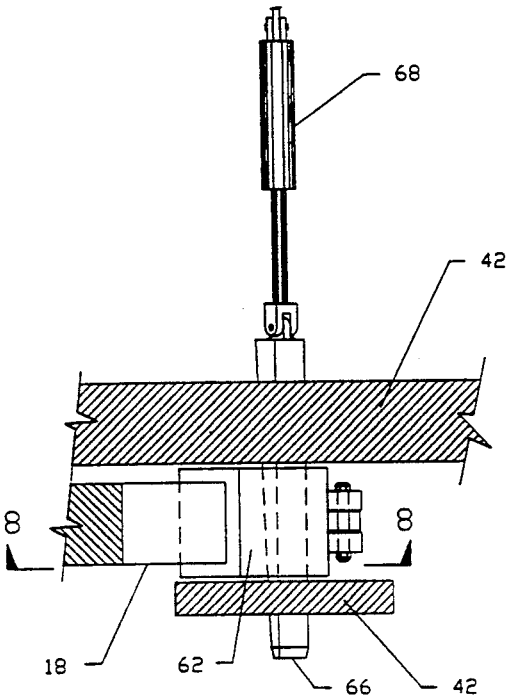
FIG. 9 is a cross-sectional view taken along the line 9—9 of FIG. 8, FIGS. 10, 11, 12 and 13 are fragmentary elevational views illustrating the method of engagement of one of the locking bars of the present invention with a set of rack teeth.

Referring now to FIGS. 8 and 9, a second embodiment of the present invention is best seen in which one or more locking means, generally indicated by the reference numeral 60, are provided having a locking bar 62 which is longitudinally movable in a direction substantially normal to the face of one of the teeth on the rack teeth 18. While a single locking apparatus 60 may be used, several may be used, as shown in FIG. 8 by stacking them one above the other. The locking bars 62 are each actuated by an air or hydraulic piston and cylinder assembly 64, and each locking bar 62 is retained in place by a wedge 66 actuated by an air or hydraulic piston and cylinder assembly 68.

Figure 10:
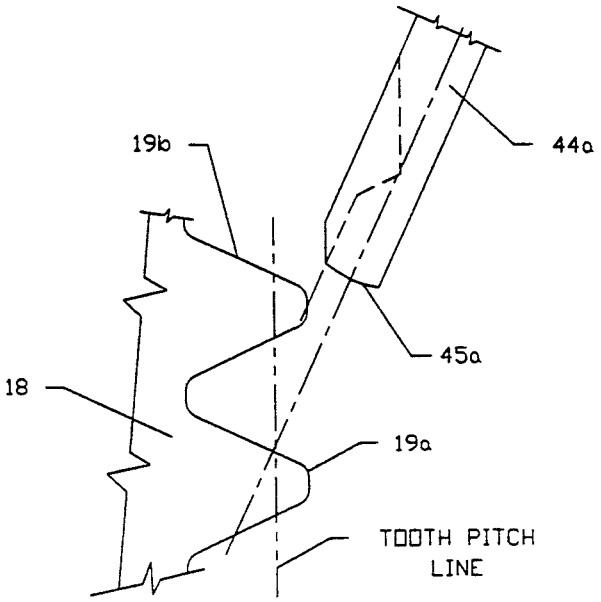
Figure 11:
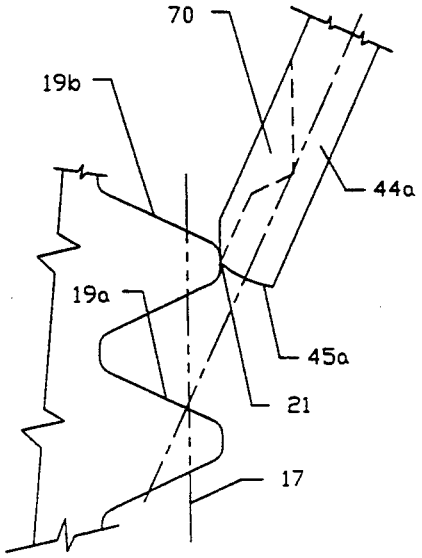
Figure 12:
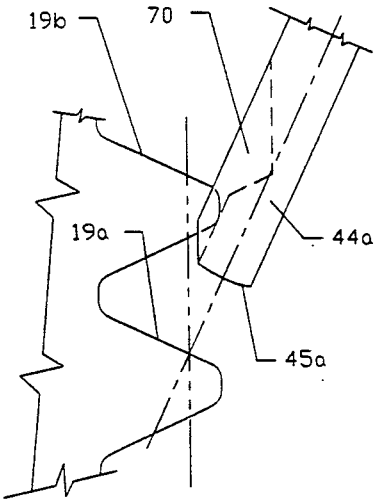
Figure 13:
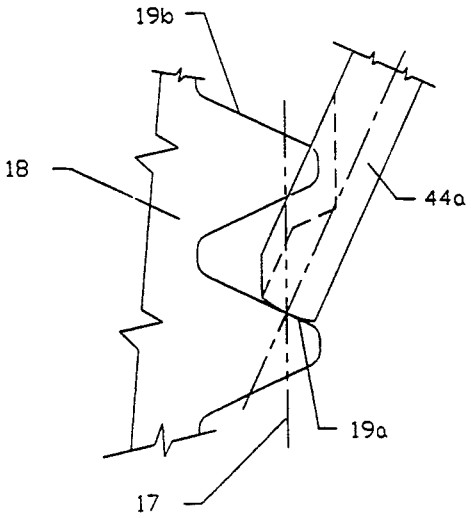

It is desirable that any of the locking bars engage the face of their coacting tooth on the tooth pitch line and as near as possible to the root of the teeth on the rack 18. Referring now to FIGS. 10, 11, 12 and 13, a sequence of operation for one of the locking bars, such as bar 44*a* of FIGS. 4–8, shows its positioning and structure for the preferred engagement of the rack teeth 18. The operation of the other bars will be similar. The locking bar 44*a* will be retracted and the relationship between the hull 12 and the rack teeth 18 will be controlled by the pinions 32 to elevate the barge 12 when the jackup rig 10 has arrived on location. With the locking bars, such as 44*a*, in the retracted position, as best seen in FIG. 10, the elevating system, such as the pinions 32, are used to adjust the location of the rack teeth 19*a* and 19*b* relative to the tips of the locking bars, such as 45*a*, by lifting the barge hull up or down. The locking bar 44*a* is actuated by the hydraulic or air piston and cylinder assembly 40 (FIG. 4) until the end 45*a* of the locking bar 44*a* makes contact, as best seen in FIG. 11, with the end 21 of the tooth 19*b*. With the cylinder 40 energized, to maintain pressure on the locking bar 44*a*, the elevating system is used to lower the barge hull 12 until all of the locking bars, including 44*a*, are able to slide past the tips, such as tip 21, of rack tooth 19*b*, at which point the elevating system is stopped. This is the position shown in FIG. 12 Locking bar 44*a* can now fully extend such that the tip 45*a* of the locking bar 44*a* is properly positioned, as best seen in FIG. 13, to engage the pitch line 17 of tooth 19*a*. After the locking bar, such as 44*a*, has fully engaged the surface 19*a* of the teeth on the rack 18, the securing wedges, such as 50*a* (FIG. 4), can be inserted into and retain the bar 44*a* in position.

Referring again to FIGS. 10, 11, 12, 13 and 6, it is to be noted that it is preferable to provide a recess 70 in the top face of the locking bars, such as 44*a*, which allows for some vertical movement of a rack tooth as the hull 12 and locking bar 44 are raised, thereby aiding in insuring that the locking bars can be easily unloaded during the disengagement operation without contacting the lower face of rack tooth 19. For purposes of illustration only, the tooth profile angle of the teeth on the rack 18 is shown as 25°. In the event that this angle is further increased, such as to 30°, it would be much easier for the locking bars to engage the pitch line of the teeth.

Upon completion of the drilling, production, or workover operations, the weight of the hull 12 must be transferred back to the elevating pinions 32 and the locking apparatus 40 or 60 disengaged to allow lowering of the hull 12 into the water for relocation of the jackup rig 10 to the next location. With the cylinder 40 energized to apply a retraction pressure, the elevating pinions 32 are energized to remove the uplifting or locking force by rotating in a direction to lift the hull 12. Rotation of the pinions 32 continues until the hull 12 is just lifted, and is then stopped. As lifting of the hull 12 unloads the locking bars, the securing wedges can then be retracted such that the power cylinder 40 fully retracts the locking bars. After this, the pinions 32 are actuated to lower the hull 12.

Figure 14:
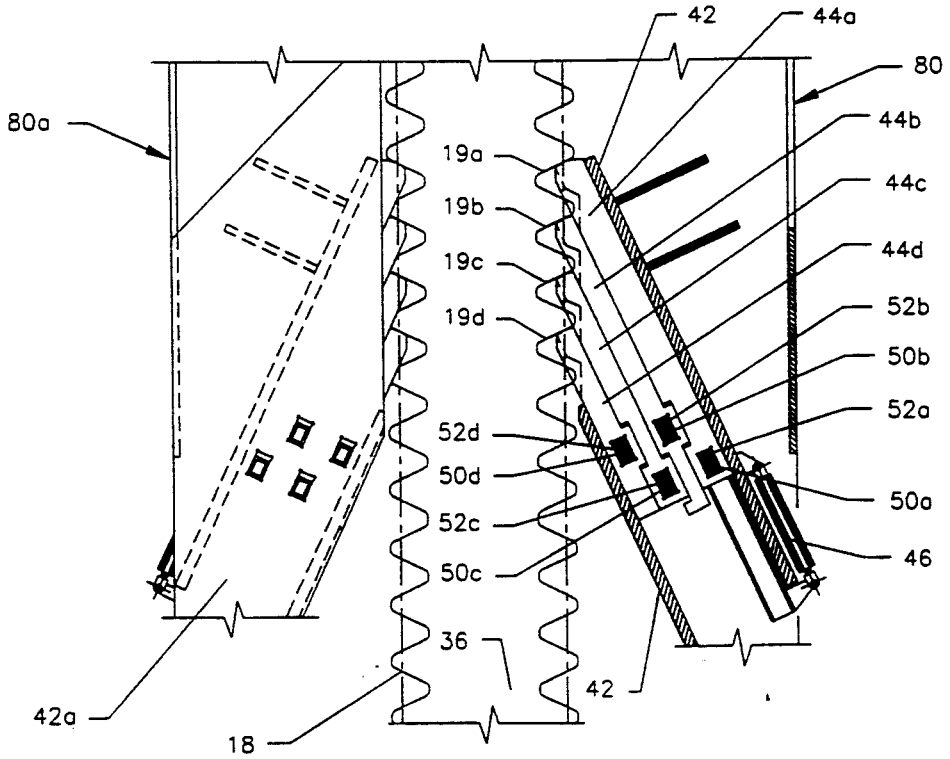
FIG. 14 is an elevational view of a further embodiment of the present invention.
Figure 4:
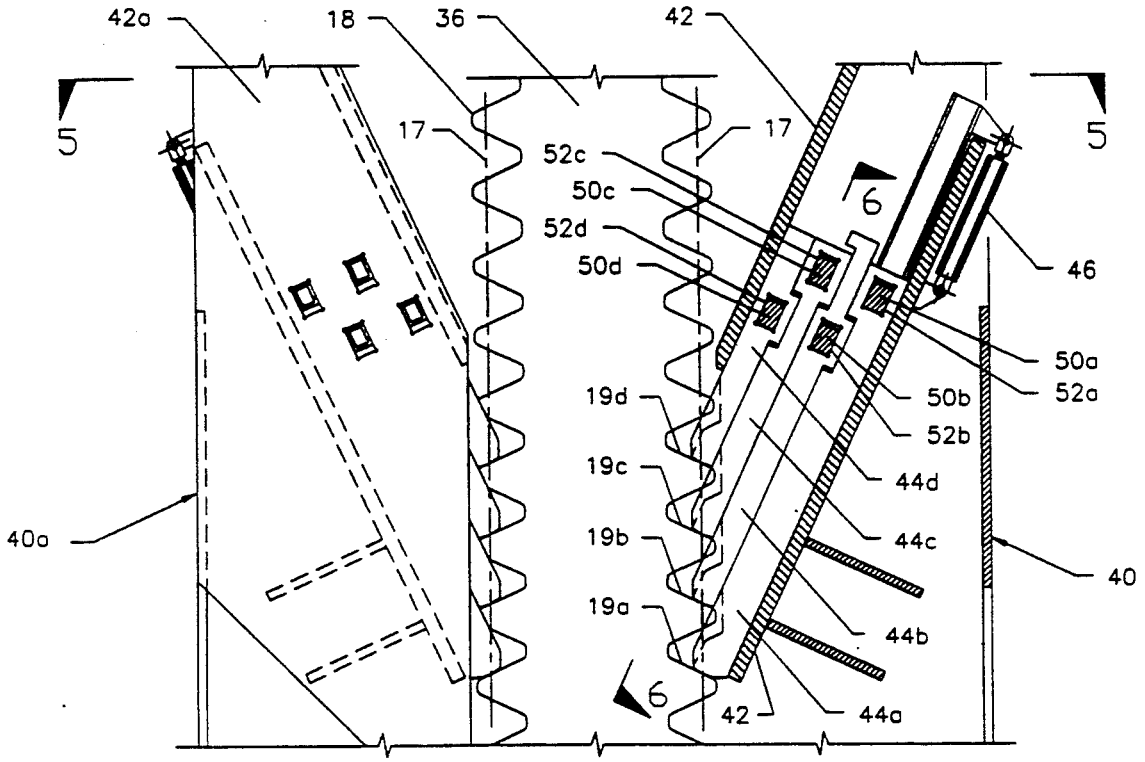
FIG. 4 is a fragmentary elevational view, partly in cross section, showing the locking apparatus of the present invention.
Figure 5:
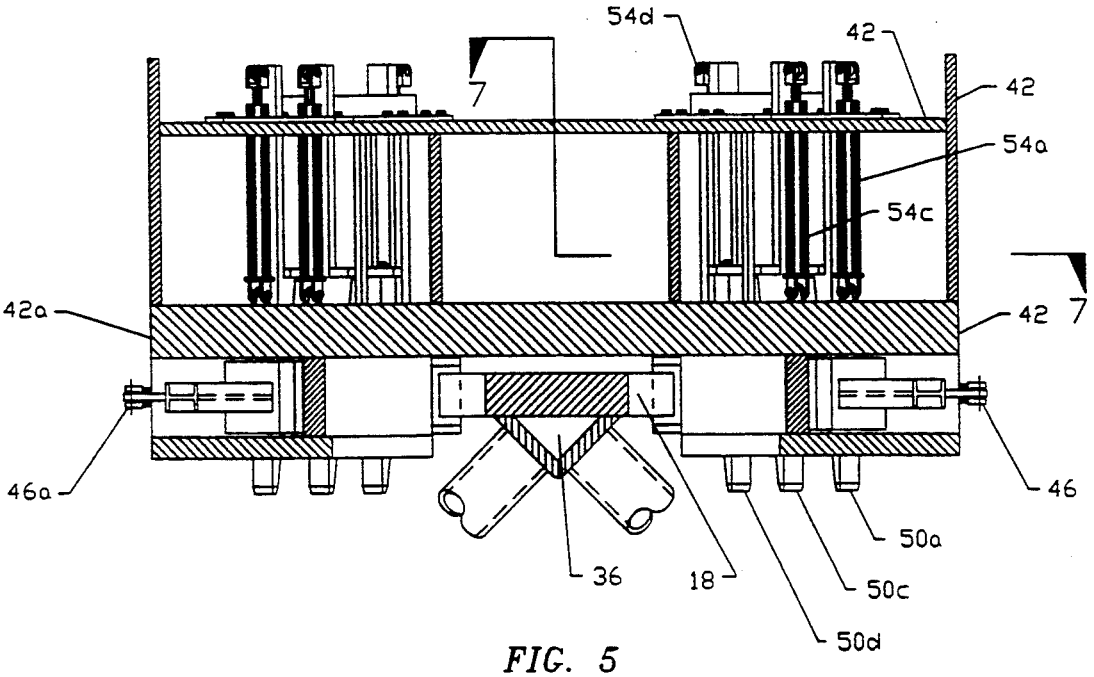
FIG. 5 is a cross-sectional view taken along the line 5—5 of FIG. 4.
Figure 6:
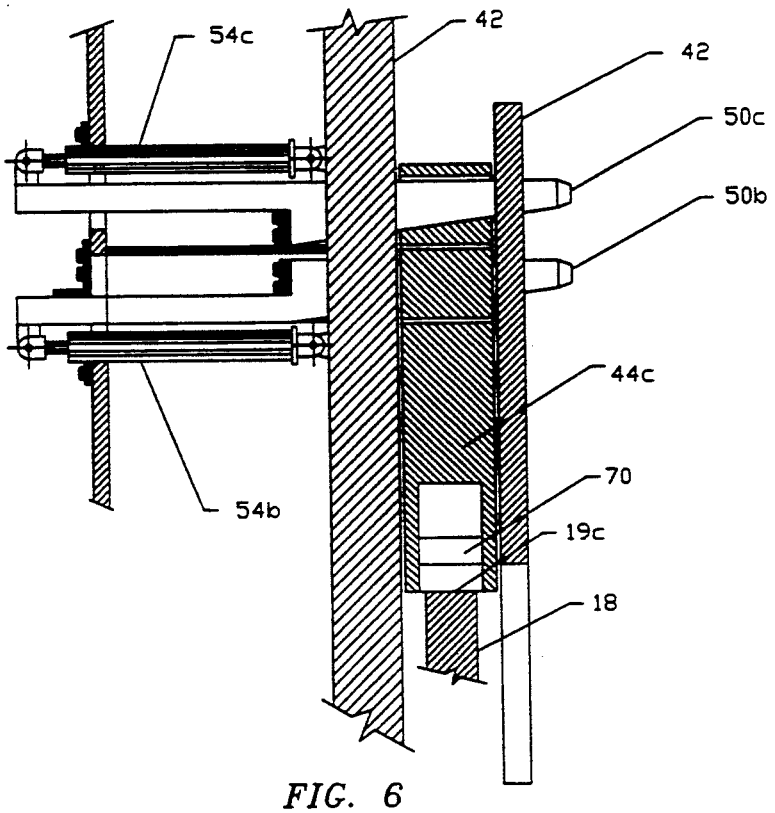
FIG. 6 is a cross-sectional view taken along the line 6—6 of FIG. 4.
Figure 7:
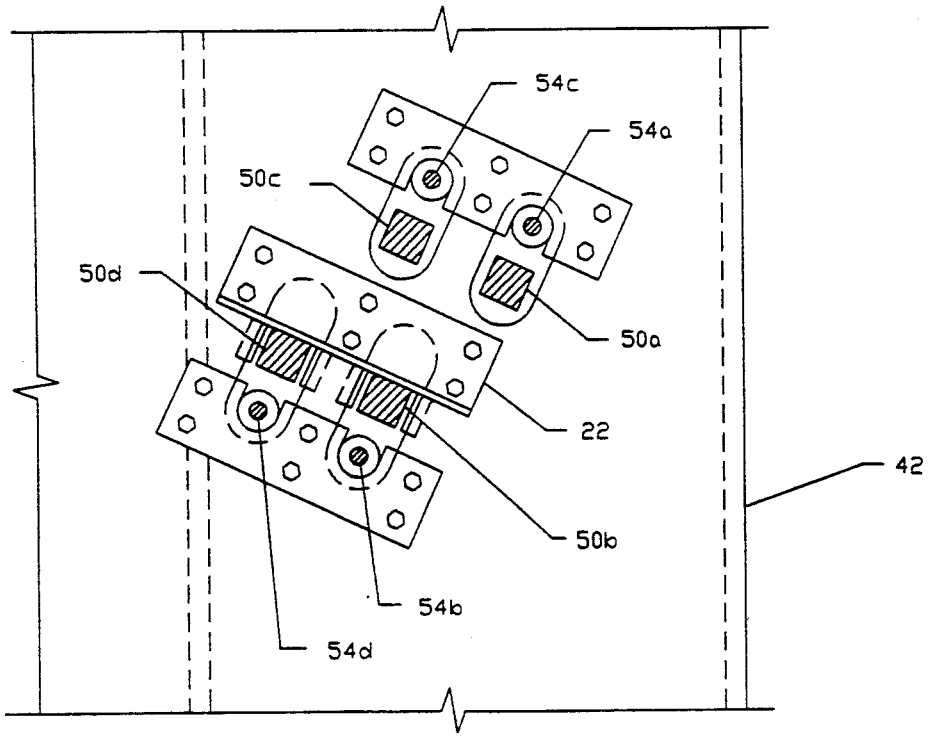
FIG. 7 is a cross-sectional view taken along the line 7—7 of FIG. 5.

Still another embodiment of the present invention includes a locking apparatus as illustrated in FIG. 14, which could be installed upon the jackup rig 10 in addition to or separate from the locking apparatus 40 or 60 as previously described. The locking unit 80 is designed to support and lock the position of the legs 14 relative to the hull 12 when the legs 14 are in the fully or partially elevated position, such as for towing the rig 10 to a new location. Basically, the locking system 80 is similar to the locking system 40, but is installed in an inverted configuration with the locking bars being actuated upwardly for engagement with the bottom face of the rack teeth 18. For convenience, similar parts in FIG. 14 to those in FIGS. 4–8 are similarly numbered with the addition of "'".

The method of locking a hull of an offshore rig relative to at least one leg extending through the hull in which at least one set of rack teeth is attached to each of the legs and pinion gears is attached to the hull to engage the teeth is apparent from the foregoing description of the apparatus. However, the method includes supporting at least one locking bar from the hull for longitudinal movement substantially normal to the plane of one of the faces of the teeth, elevating the hull relative to the legs by said pinion gears to the desired height, moving the locking bar longitudinally to engage the face of one of the rack teeth, holding said bar in engagement with the tooth and rotating the pinions to apply an upward force on the legs relative to the hull thereby locking the legs to the hull in both an upward and downward vertical direction.

The method further includes the sequence of wherein the bars are brought into engagement with the tip of a rack tooth prior to engagement with a tooth face and thereafter lowering the hull relative to the legs to allow the bars to slide past the tooth tip, and moving the locking bars into engagement with the next lower tooth.

The method further includes moving a plurality of locking bars in a direction substantially normal to the face of a rack tooth wherein each of the bars are movable relative to the other bars to accommodate inaccuracies in the configuration of the teeth. The method further includes individually retaining each of the locking bars in engagement with one of the teeth.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts, and steps of the method, will be readily apparent to those skilled in the art and which are encompassed within the spirit of the invention and the scope of the appended claims.

What is claimed is:

1. An offshore jackup rig locking apparatus for use in an offshore rig having a leg extending adjacent to or through a hull and a set of rack teeth attached to the leg, each of the rack teeth having an outer end and two faces, an upper top face and a lower bottom face, the faces extending from the outer end of the tooth non-parallel to each other, the leg having a longitudinal axis, the locking apparatus comprising, a locking bar supported from the hull, the locking bar having a longitudinal axis, the locking bar movable with its longitudinal axis at an acute angle to the longitudinal axis of the leg to contact one face of one rack tooth without contacting the other face of the rack tooth, power means for moving the locking bar toward and away from the rack tooth, and retention means engaging the locking bar for holding the locking bar in engagement with the one face of the rack tooth.

2. The apparatus of claim 1 wherein the locking bar includes a recess for allowing vertical movement of a rack tooth during a disengagement operation assuring contact will not be made between the locking bar and the face of an adjacent rack tooth not in contact with the locking bar.

3. The apparatus of claim 1 wherein said retention means includes a wedge member transversely movable relative to the longitudinal axis of the locking bar.

4. The apparatus of claim 1 including piston and cylinder means for moving the locking bar along a longitudinal axis thereof and for transversely moving the retention means.

5. The locking apparatus of claim 1 wherein the locking bar contacts only the upper top face of the rack tooth without contacting a lower bottom face of an adjacent rack tooth.

6. The locking apparatus of claim 1 wherein the locking bar contacts only the lower bottom face of the rack tooth without contacting an upper top face of an adjacent rack tooth.

7. An offshore jackup rig locking apparatus for use in an offshore rig having at least one leg extending adjacent to or through a hull and at least one set of rack teeth attached to each of the legs, each of the rack teeth having an outer end and two faces, an upper top face and a lower bottom face which extend from the outer end of the tooth and are non-parallel to each other, the locking apparatus comprising, a plurality of locking bars supported from the hull, each of the bars being movable in a direction substantially normal to one face of one of the rack teeth without contacting the other face of the respective rack tooth and without contacting any face of any adjacent rack tooth, each of said bars being movable relative to and independently of the other bars, power means for moving the bars toward said teeth, and retention means engaging each of the locking bars for holding each of the locking bars in engagement with one face of one of the rack teeth.

8. The apparatus of claim 7 wherein said locking bars are positioned side-by-side and engage consecutive rack teeth.

9. The apparatus of claim 7 wherein said bars are interlockable with each other.

10. The apparatus of claim 7 wherein each of the locking bars includes a recess to allow vertical movement of a rack tooth during a disengagement operation assuring contact will not be made between the locking bar and faces of an adjacent rack tooth not in contact with the locking bar.

11. The apparatus of claim 7 wherein said retention means includes a plurality of wedge members, each wedge member corresponding to one of the locking bars and transversely movable relative to a longitudinal axis of the corresponding locking bar.

12. The apparatus of claim 7 including also piston and cylinder means for moving the locking bars along respective longitudinal axes thereof and for transversely moving the retention means.

13. The locking apparatus of claim 7 wherein each of the locking bars contact only an upper top face of a rack tooth without contacting a lower bottom face of an adjacent rack tooth.

14. The locking apparatus of claim 7 wherein each of the locking bars contacts only a lower bottom face of a rack tooth without contacting an upper face of an adjacent rack tooth.

15. A method of locking a hull of an offshore jackup rig relative to at least one leg extending adjacent to or through the hull in which at least one set of rack teeth is attached to each of the legs and pinion gears are attached to the hull to engage the teeth, each rack tooth having an outer end and two faces including an upper planar face and a lower planar face, the faces extending from the outer end of the tooth and their planes at an angle to each other, the method comprising, supporting at least one locking bar from the hull for movement toward one of the faces of one rack tooth, moving the hull relative to the legs by said pinion gears to the desired height, moving the locking bar at an acute angle to a longitudinal axis of the leg to engage one face of the one rack tooth, holding the locking bar in engagement with the one face of the one rack tooth, and rotating the pinions to apply a force on the legs relative to the hull thereby locking the legs to the hull in both an upward and downward vertical direction.

16. The method of claim 15 wherein the at least one locking bar is brought into engagement with the outer end of a rack tooth prior to engagement with a load-bearing tooth face and thereafter, moving the hull relative to the legs to allow the at least one locking bar to slide past the outer end of the tooth with which it had been brought into engagement, and moving the at least one locking bar into engagement with the load-bearing face.

17. The method of claim 15 including, moving each of a plurality of locking bars in a direction substantially normal to one face of a rack tooth wherein each of the bars are movable relative to the other bars to accommodate inaccuracies in the configuration of the rack teeth.

18. The method of claim 17, including, individually retaining each of the locking bars in engagement with one face of one of the rack teeth.

* * * * *